US008746186B2

(12) United States Patent
Sullivan et al.

(10) Patent No.: US 8,746,186 B2
(45) Date of Patent: Jun. 10, 2014

(54) ROTATING SCREEN FOR CENTRIFUGAL FAN

(75) Inventors: Ryan Sullivan, West Bend, WI (US); Gary S. Johnson, Hales Corners, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 13/592,803

(22) Filed: Aug. 23, 2012

(65) Prior Publication Data

US 2014/0053793 A1 Feb. 27, 2014

(51) Int. Cl.
*F01P 7/04* (2006.01)

(52) U.S. Cl.
USPC ..... 123/41.65; 123/198 E

(58) Field of Classification Search
USPC ..... 123/41.65, 41.7, 198 E, 195 C; 416/189, 416/223 R, 119, 238, 203, 175, 198 R, 63, 416/60, 55, 195; 415/121.2
See application file for complete search history.

(56) References Cited

U.S. PATENT DOCUMENTS

| | | | | |
|---|---|---|---|---|
| 4,358,245 | A * | 11/1982 | Gray | 416/189 |
| 7,225,765 | B2 * | 6/2007 | Leech et al. | 123/41.7 |
| 7,794,204 | B2 * | 9/2010 | Stevens et al. | 415/220 |
| 2009/0293835 | A1 * | 12/2009 | Nakamizo | 123/198 E |

OTHER PUBLICATIONS

"2121370 booster fan"—illustrates a rotating screen for use with an internal combustion engine commercially available at least as early as Aug. 22, 2011.
"Honda v-twin rotating screen"—illustrates a rotating screen for use with an internal combustion engine commercially available at least as early as Aug. 22, 2011.

* cited by examiner

*Primary Examiner* — Hung Q Nguyen
(74) *Attorney, Agent, or Firm* — Michael Best & Friedrich LLP

(57) ABSTRACT

A rotating screen, for use with a centrifugal fan of an engine, includes a hub having a rotational axis and a plurality of blades extending radially outwardly from the hub. Each of the blades includes a root adjacent the hub, a tip, a leading edge extending between the root and the tip, and a trailing edge extending between the root and the tip. The blades also include an airfoil shape. The rotating screen also includes a band concentric with the hub and interconnecting the tips of the respective blades.

25 Claims, 6 Drawing Sheets

ROTATING SCREEN FOR CENTRIFUGAL FAN

FIELD OF THE INVENTION

The present invention relates centrifugal fans, and more particularly to rotating screens for use with centrifugal fans.

BACKGROUND OF THE INVENTION

Centrifugal fans are often used for generating a cooling airflow for internal combustion engines, particularly in such engines for use in lawn mowers. In some cases, these engines may operate in an environment where airborne contaminants such as dust, grass, or gratings may interfere with the operation or performance of the centrifugal fan. Stationary screens or filters may be employed to inhibit contaminants from being drawn into the centrifugal fan, but these screens or filters may become clogged and require frequent cleaning.

Such stationary screens are designed as an inadvertent cover for keeping an operator's extremities from contacting the rotating screen and/or centrifugal fan. Typically, some airborne contaminants pass through the stationary screen, which can clog a rotating screen if used. This requires that the stationary screen to be removed to clean the airborne contaminants from the rotating screen.

SUMMARY OF THE INVENTION

The present invention provides, in one aspect, a rotating screen for use with a centrifugal fan of an engine. The rotating screen includes a hub having a rotational axis and a plurality of blades extending radially outwardly from the hub. Each of the blades includes a root adjacent the hub, a tip, a leading edge extending between the root and the tip, and a trailing edge extending between the root and the tip. The blades also include an airfoil shape. The rotating screen also includes a band concentric with the hub and interconnecting the tips of the respective blades.

The present invention provides, in another aspect, an engine including a crankcase, a cover at least partially enclosing the crankcase, a centrifugal fan that is rotatable while the engine is in use for discharging a cooling airflow between the crankcase and the cover, and a screen coupled for co-rotation with the centrifugal fan. The screen includes a hub having a rotational axis and a plurality of blades extending radially outwardly from the hub. Each of the blades includes a root adjacent the hub, a tip, a leading edge extending between the root and the tip, and a trailing edge extending between the root and the tip. The blades also include an airfoil shape. The rotating screen also includes a band concentric with the hub and interconnecting the tips of the respective blades.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
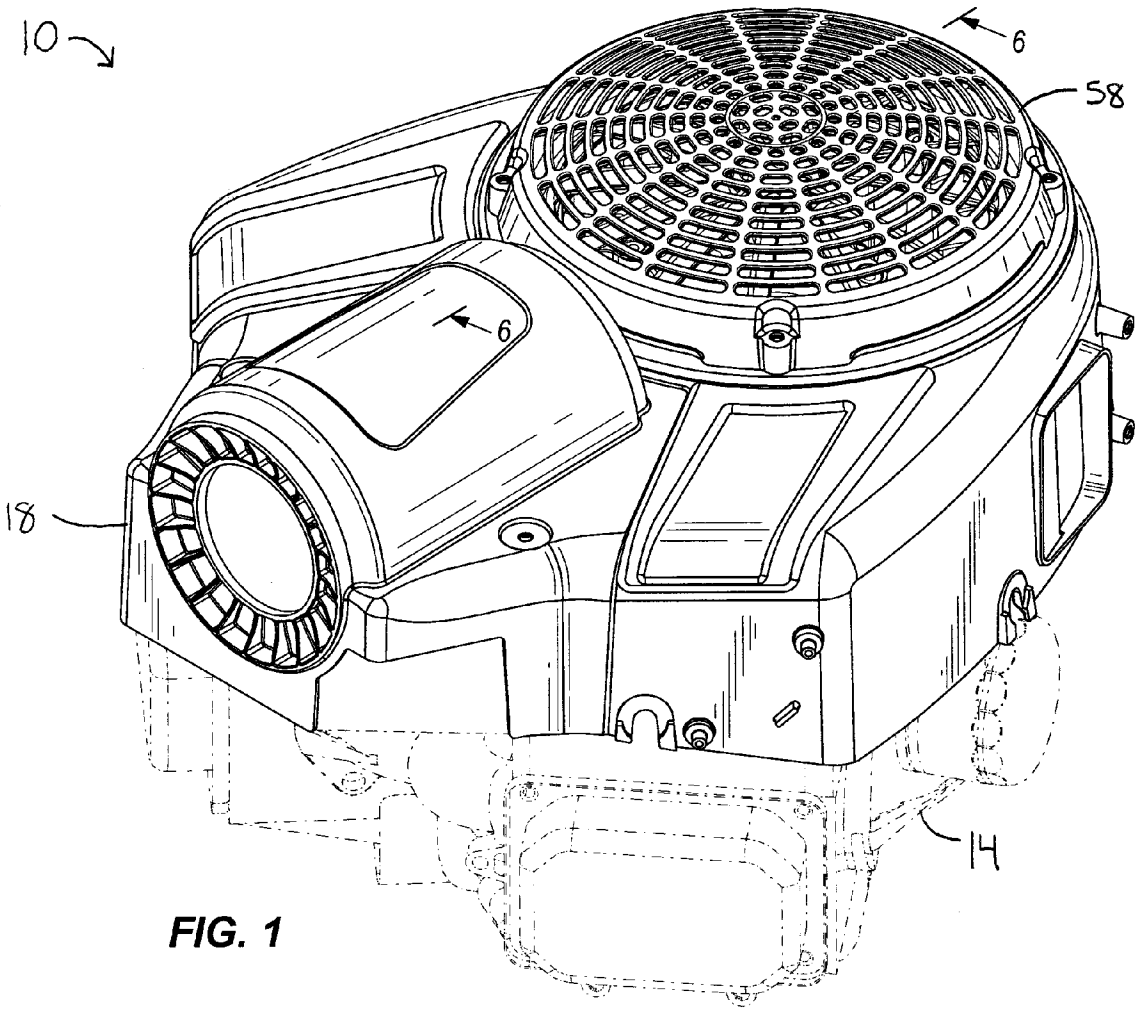
FIG. 1 is a perspective view of an engine including a rotating screen of the present invention.
Figure 2:
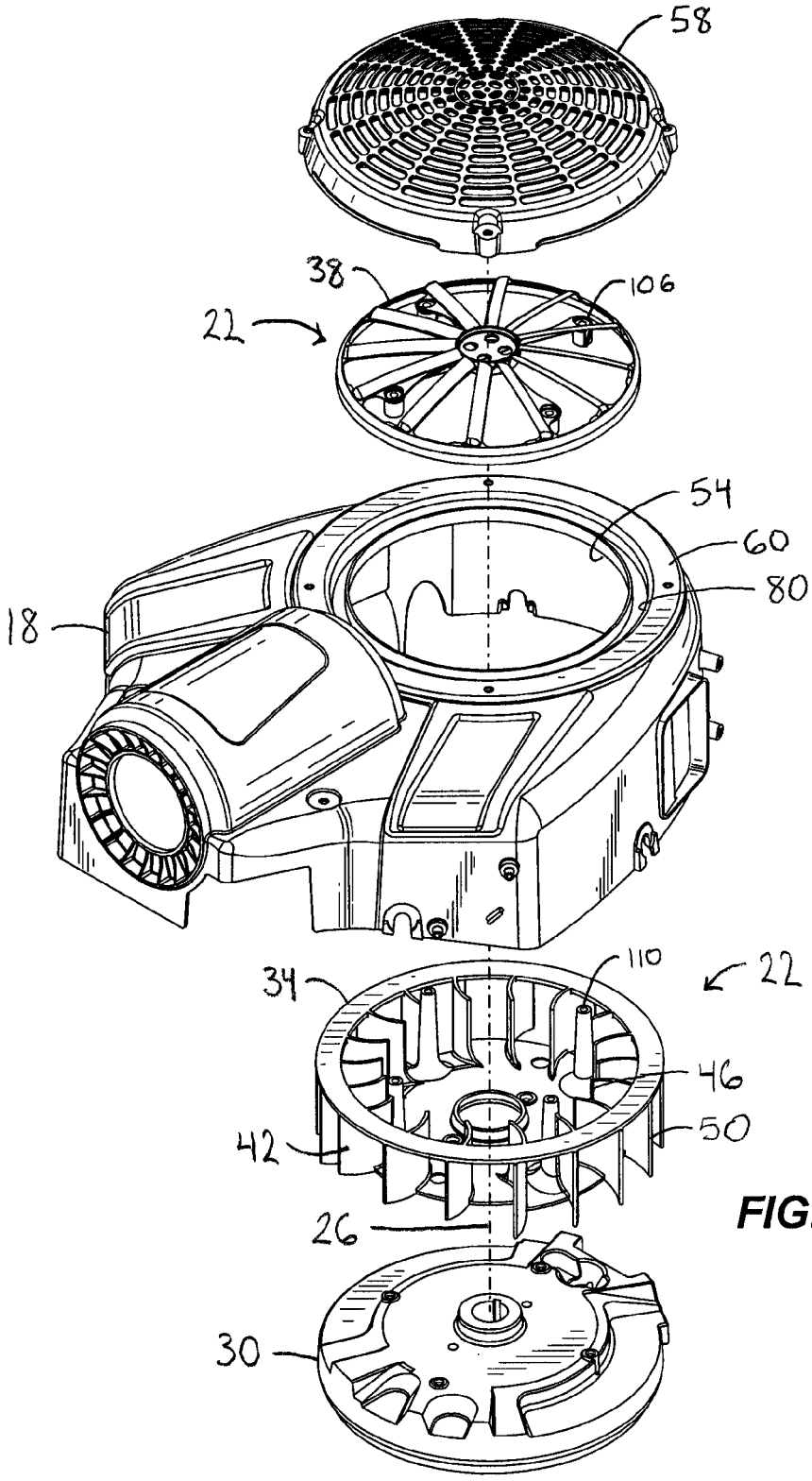
FIG. 2 is an exploded perspective view of the engine of FIG. 1, illustrating the rotating screen and a centrifugal fan to which the screen is attached.

FIG. 1 illustrates a small, air-cooled, four-stroke internal combustion engine 10 including a crankcase 14 and a crankcase cover 18 that at least partially encloses the crankcase 14. The engine 10 includes two cylinders arranged in a V-twin configuration; however, the engine 10 may alternatively include a single cylinder or more than two cylinders in any of a number of different configurations (e.g., inline, horizontally opposed, etc.), and so forth. The engine 10 may be configured with a power output as low as 5 hp and as high as 35 hp to operate engine-driven outdoor power equipment (e.g., lawn mowers, zero-turn radius mowers, lawn tractors, snow throwers, pressure washers, generators, concrete saws, etc.). With reference to FIG. 2, the engine 10 also includes a centrifugal fan assembly 22 attached to a flywheel 30 which, in turn, is coupled to a crankshaft 32 (FIG. 6) in the engine 10 that is rotatable about an axis 26 while the engine is in use.

With continued reference to FIG. 2, the centrifugal fan assembly 22 includes a centrifugal fan 34 and a screen 38 coupled to the fan 34 for co-rotation. The centrifugal fan 34 includes a plurality of fan blades 42 configured to discharge a cooling airflow through an airspace defined between the crankcase 14 and the crankcase cover 18 for removing waste heat from the crankcase 14. The fan blades 42 each include a leading edge 46 and trailing edge 50, the leading edges 46 of the respective fan blades 42 defining an inlet through which axially-directed air is drawn. The cooling airflow is discharged from the centrifugal fan 34 in a radially outward direction past the trailing edges 50 of the respective fan blades, and into the airspace between the crankcase 14 and the crankcase cover 18. The centrifugal fan 34 draws the cooling airflow from an inlet aperture 54 in the crankcase cover 18. The inlet aperture 54 is covered by a stationary screen 58 to prevent an operator from contacting the fan 34 and to prevent large debris from being drawn into the air inlet and damaging the centrifugal fan 34. In the illustrated construction of the engine 10, the stationary screen 58 is fastened to an annular flange 60 on the crankcase cover 18 by conventional fasteners (e.g., screws); however, other suitable fastening means may be employed.

Figure 3:
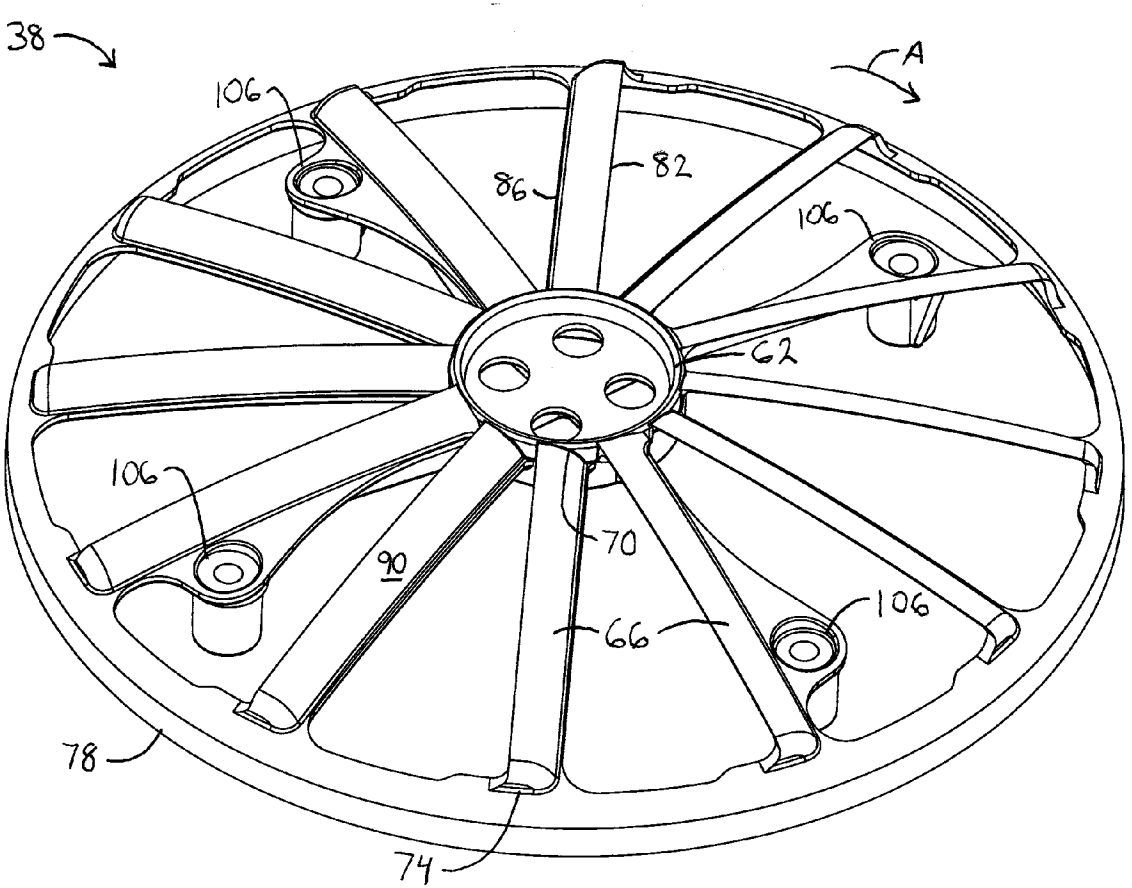
FIG. 3 is an enlarged perspective view of the rotating screen of FIG. 2.
Figure 4:
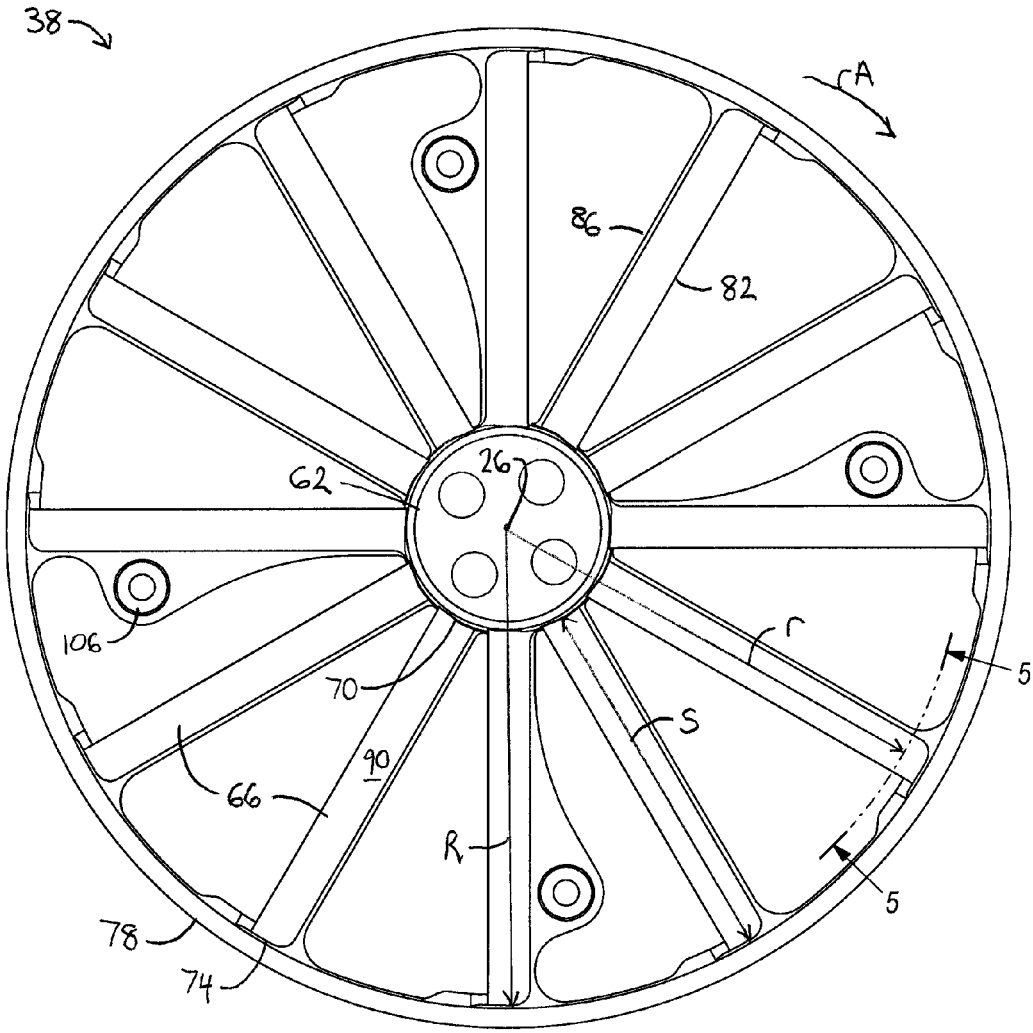
FIG. 4 is a top plan view of the rotating screen of FIG. 3.

As shown in FIGS. 3 and 4, the rotating screen 38 includes a central hub 62 and a plurality of blades 66 extending radially outward from the central hub 62. In the illustrated construction, the rotating screen 38 includes 12 blades. Alternatively, the screen 38 may include as few as 4 blades, or as many as 16 blades. Also, in the illustrated construction of the screen 38, the blades 66 extend from the hub 62 purely in a radial direction (i.e., without skew). Alternatively, the blades 66 may include a forward or backward skew, or the blades 66 may be offset from the axis 26 such that they intersect the hub 62 in a substantially tangential manner.

Each of the blades 66 includes a root 70 adjacent the hub 62 and a tip 74 spaced outwardly from the root 70 (FIG. 3). The rotating screen 38 also includes a band 78 concentric with the hub 62 that interconnects the tips 74 of the blades 66 to provide strength and rigidity to the screen 38. The radial distance between the axis 26 and the tips 74 of the respective blades 66 is defined as the maximum blade radius "R" of the rotating screen 38, while the radial distance between the root 70 and the tip 74 of each of the blades 66 is defined as the blade span "S" (FIG. 4). The hub 62, the blades 66, and the band 78 may be integrally formed as a single piece by a suitable process, such as injection molding or casting.

With continued reference to FIG. 4, several characteristics of the blades 66 may vary over the span S. Particularly, these characteristics may be measured at discrete cylindrical blade sections (e.g., line 5-5) corresponding with a radius "r" moving from the root 70 of the blade 66 to the tip 74 of the blade 66. A blade section having radius "r" is thus defined at the intersection of the rotating screen 38 with a cylinder having radius "r" and an axis collinear with the rotational axis 26 of the screen. As previously discussed, the blade section corresponding with the tip 74 of the blade 66 has a radius "R" equal to the maximum radius of the blades 66 of the rotating screen 38. Therefore, characteristics of the blades 66 which vary over the span S can be described with reference to a particular blade section at a fraction (i.e., "r/R") of the blade radius R. As used herein, the fraction "r/R" may also be referred to as the "non-dimensional radius."

With continued reference to FIG. 4, each of the blades 66 also includes a leading edge 82 between the root 70 and the tip 74 and a trailing edge 86 between the root 70 and the tip 74 relative to a clockwise rotational direction of the centrifugal fan assembly, indicated by arrow "A".

Figure 5:
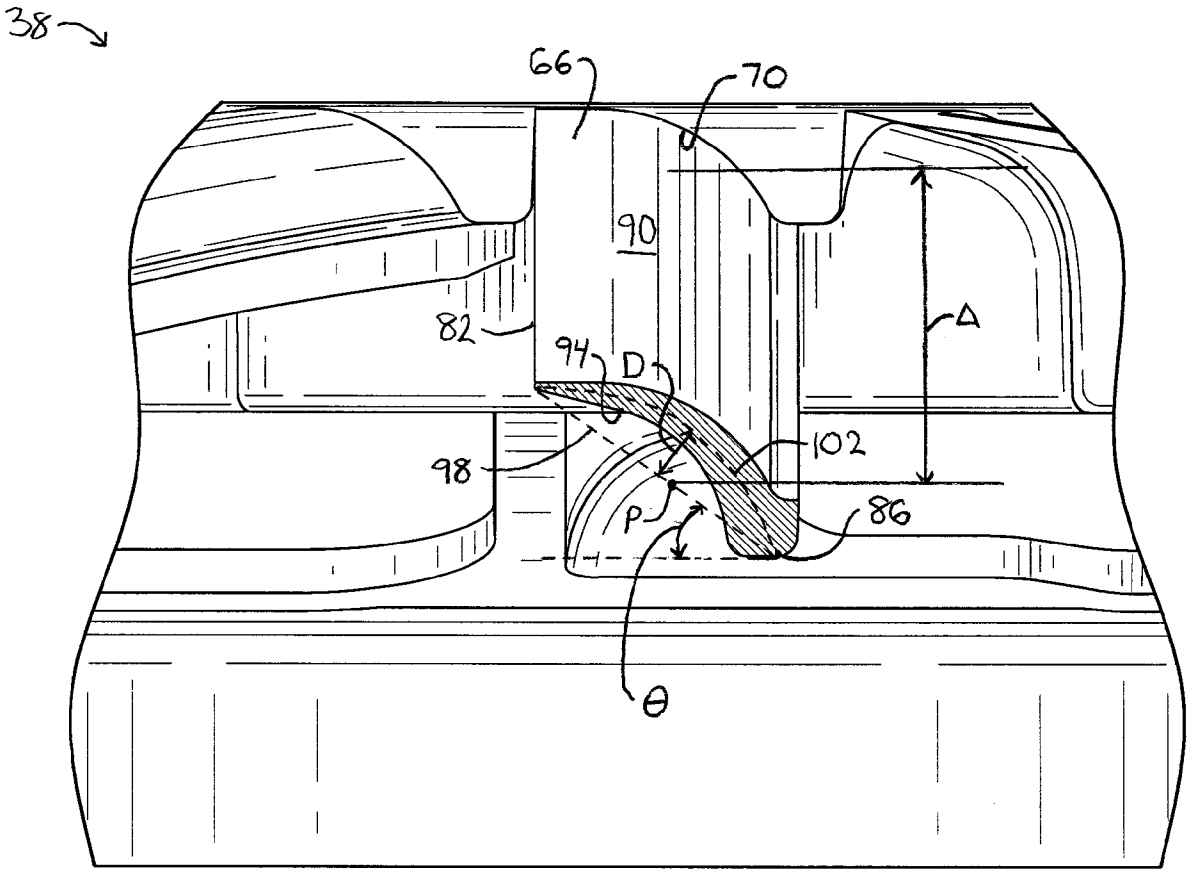
FIG. 5 is a cross-sectional view of a portion of the rotating screen of FIG. 4 through line 5-5 in FIG. 4.

With reference to FIG. 5, a blade section near the end of the span S (i.e., r/R~1) is shown. Each of the blades 66 includes a suction surface 90 and a pressure surface 94 which together define an airfoil shape. In other words, each of the suction surface 90 and the pressure surface 94 includes an arcuate shape over which air flows as the screen 38 is rotated. The pressure surface 94, due to its arcuate shape or curvature, deflects the air encountered by the blades 66 downward from the frame of reference of FIG. 5 toward the inlet of the centrifugal fan 34. The curvature of the respective surfaces 90, 94 also induces a pressure differential in the air on either side of each of the blades 66. Particularly, the air flowing over the lower side of each of the blades 66 (i.e., corresponding with the pressure surface 94) is at a higher pressure compared to the air flowing over the upper side of each of the blades 66 (i.e., corresponding with the suction surface 90). Accordingly, the static pressure of the air beneath the rotating screen 38 is increased as a result of the airfoil shape of each of the blades 66.

Each of the blades 66 is defined by i) a nose-tail line 98, which is a straight line that extends from the leading edge 82 to the trailing edge 86, and ii) a mean line 102, which extends from the leading edge 82 to the trailing edge 86, half-way between the suction surface 90 and the pressure surface 94 of each of the blades 66. The blade section shown in FIG. 5 has a curvature, otherwise known as "camber." Camber is a non-dimensional quantity defined as a perpendicular distance "D" between the mean line 102 and the nose-tail line 98 divided by the length of the nose-tail line 98, otherwise known as the blade "chord." Generally, the larger the non-dimensional quantity of camber, the greater the curvature of the blade. In the illustrated construction, the camber of the blades is between about 0.1 and about 0.3. Preferably, the camber is about 0.2. In the illustrated embodiment of the screen 38, the camber is substantially constant for any non-dimensional radius "r/R" along the span S of each of the blades 66. Alternatively, the camber may vary with radius "r" along the span S of each of the blades 66 (for example, the camber may increase as non-dimensional radius "r/R" increases, the camber may decrease as non-dimensional radius "r/R" increases, the camber may have a minimum or maximum at a point along the span, etc.).

With continued reference to FIG. 5, each of the blades 66 also defines a pitch angle "θ." The pitch angle θ is defined as the angle between the nose-tail line 98 and a plane substantially normal to the axis 26. In the illustrated construction of the rotating screen 38, the blades 66 define a non-zero, positive pitch angle θ along the entire span S of each of the blades 66. Additionally, each of the blades 66 has substantially the same pitch angle θ, between about 25 degrees and about 45 degrees. Preferably, the pitch angle θ is about 35 degrees. In alternative constructions, the pitch angle θ may vary with the blade radius "r" from the root 70 to the tip 74. From the pitch angle θ, the "pitch" of each of the blades 66 may be calculated with the equation:

$$\text{Pitch}=2\pi r \tan\theta$$

The pitch of each of the blades 66 is a characteristic that generally governs the amount of static pressure generated by the blade 66 along its radial length. As is evident from the above equation, pitch is a dimensional quantity and is visualized as the axial distance theoretically traveled by the particular blade section at radius "r" through one revolution, if rotating in a solid medium, akin to a screw being threaded into a piece of wood. Therefore, for a constant pitch angle θ for any value of blade radius "r" along the span S, the pitch of each of the blades increases proportionally with the increasing blade radius "r."

With continued reference to FIG. 5, each of the blades 66 further defines an axial offset "Δ," otherwise known as "rake." The rake Δ is defined as the axial distance between a midpoint "P" of the nose-tail line 98 of a particular blade section between the root 70 and tip 74 of the blade 66, and a midpoint of a nose-tail line of a blade section corresponding with the root 70 of the blade 66. In the illustrated embodiment of the screen 38, the rake Δ varies along the radius "r" of the blade 66, from a minimum value of zero inches at the root 70 to a maximum value between about 0.3 inches and 0.7 inches at the tip 74. Preferably, the rake Δ is about 0.5 inches at the tip 74. Alternatively, the rake Δ may be sized in accordance with the geometry of the engine 10, and could be greater than or less than 0.7 inches at the tip 74. Further, the rake Δ may occur in an opposite direction with respect to the root 70 of each of the blades 66 as that shown in FIG. 5.

The airfoil shape of each blade 66, including the camber, the rake Δ, and the pitch angle θ, is configured such that the rotating screen 38 acts as an axial fan and induces an axial airflow towards the inlet of the centrifugal fan 34. The axial airflow increases the static pressure of air entering the centrifugal fan 34, thereby increasing the operational efficiency of the centrifugal fan 34. Furthermore, the axial airflow being fed to the inlet of the centrifugal fan 34 also increases the flow rate of the cooling airflow that is discharged by the fan 34 between the crankcase cover 18 and the crankcase 14.

With reference to FIGS. 2 and 3, the rotating screen 38 includes four mounting bosses 106, each integrally formed as a single piece with the trailing edge 86 of a respective blade 66. The mounting bosses 106 are equally spaced, such that there are two blades 66 between adjacent mounting bosses 106. The centrifugal fan 34 (FIG. 2) includes four bosses 110 configured to align with the mounting bosses 106 on the rotating screen 38 to orient the rotating screen 38 relative to the centrifugal fan 34. Conventional fasteners (e.g., screws) are used to couple the mounting bosses 106 and the bosses 110 in the centrifugal fan 34; however, other suitable fastening means may be used. Such fasteners may be anchored in corresponding threaded bosses in the flywheel 30.

With reference to FIGS. 4 and 5, the leading edge 82 of each of the blades 66 is sharp such that the leading edge 82 is the thinnest part of the airfoil shape of the blades 66. The sharp leading edge 82 facilitates the cutting of airborne debris (e.g., grass, straw, seeds, or gratings) that happens to pass through the stationary screen 58. As such, the blades 66 may cut such debris into smaller pieces, making it less likely that the debris might otherwise clog the centrifugal fan 34 or impede performance of the centrifugal fan 34. In addition, the cut debris is more likely to be expelled from the airspace between the crankcase 14 and the crankcase cover 18 with the cooling airflow discharged by the centrifugal fan 34, rather than accumulating on the crankcase 14, the cooling fins on the crankcase 14, or the cylinder head of the engine 10. For example, the sharp leading edge 82 may be defined by a singular edge defined in part by each of the suction surface 90 and the pressure surface 94. Alternatively, the sharp leading edge 82 may include a serrated shape or other features to facilitate the cutting of airborne debris. In the illustrated construction of the screen 38, the leading edge 82 of each of the blades 66 is sharp along the entire span S of the blades 66. Alternatively, the leading edge 82 of each of the blades 66 may only be sharp along a portion of the span S of the blades 66 (e.g., proximate the tips 74 of the respective blades 66 where the tangential velocity of the blade 66 is higher relative to the roots 70).

Figure 6:
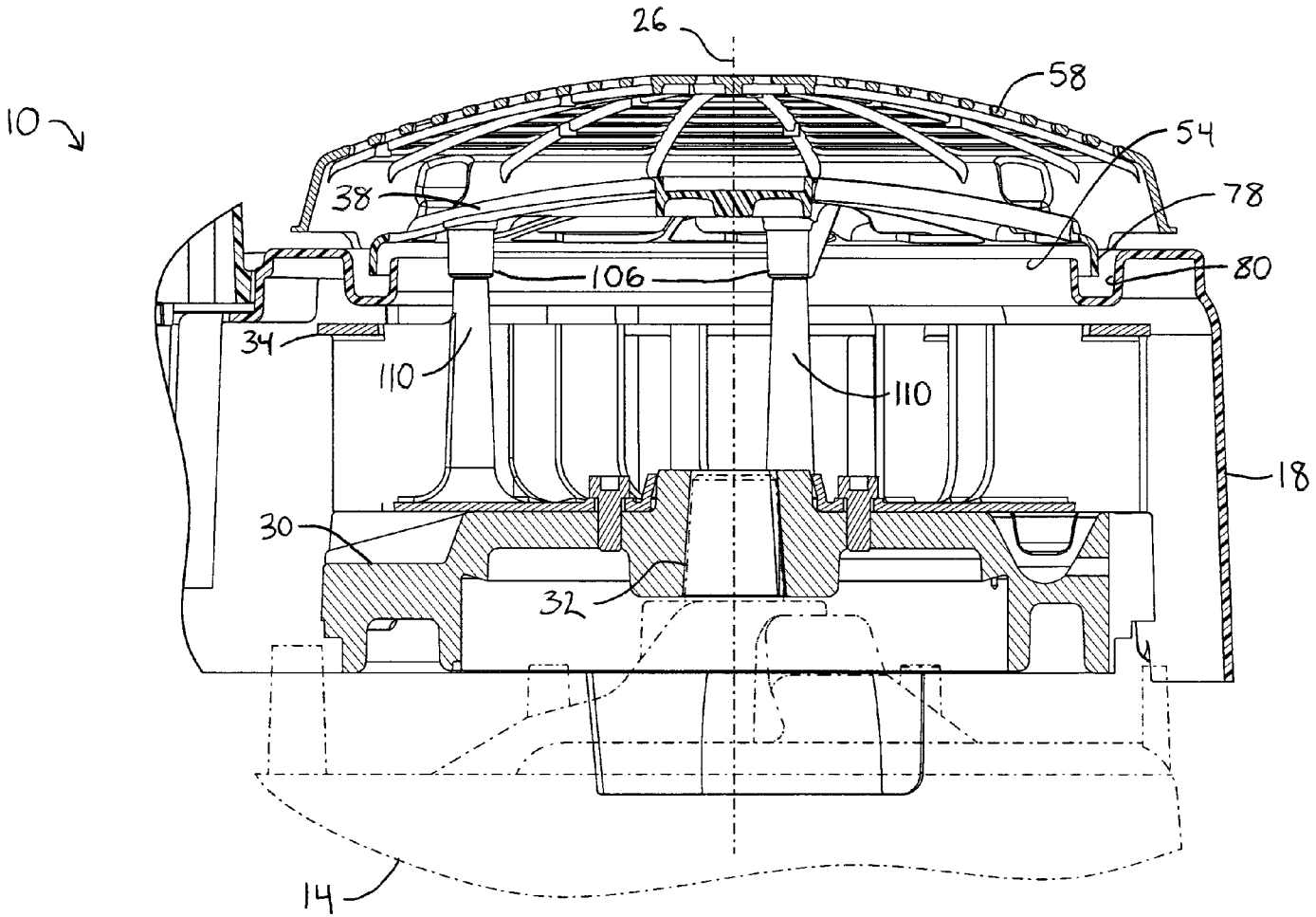
FIG. 6 is an assembled, cross-sectional view of the engine shown in FIG. 1

With reference to FIGS. 2 and 6, the crankcase cover 18 includes an annular channel 80 surrounding the inlet aperture 54. In the illustrated construction, the annular channel 80 has a substantially U-shaped cross-section; however, the annular channel 80 may have a different shape. The band 78 of the rotating screen 38 is at least partially positioned within the annular channel 80 to create a tortuous pathway leading to the inlet aperture 54, thereby inhibiting airborne debris from passing around the rotating screen 38. Therefore, only the cut debris may pass through the inlet aperture 54.

Accordingly, the top surface of the rotating screen 38 cannot be plugged. Therefore, the stationary screen 58 does not have to be removed to clean airborne contaminants from the rotating screen 38. The airfoil shape of each of the blades 66 of the rotating screen 38 allows more air to flow through the rotating screen 38, thereby providing more cooling air available to cool the engine 10. Furthermore, the sharp leading edge 82 on each of the blades 66 cuts and breaks up airborne contaminants to reduce the likelihood of those contaminants collecting on the blades 42 of the centrifugal fan 34, the cooling fins on the crankcase 14 or another portion of the engine 10, or within cooling passages in the crankcase 14 or another portion of the engine 10.

Various features of the invention are set forth in the following claims.

We claim:

1. A rotating screen for use with a centrifugal fan of an engine, the rotating screen comprising:

a hub including a rotational axis;

a plurality of blades extending radially outwardly from the hub, each of the blades including a root adjacent the hub, a tip, a leading edge extending between the root and the tip, and a trailing edge extending between the root and the tip, the blades also including an airfoil shape; and a band concentric with the hub and interconnecting the tips of the respective blades, wherein the leading edge is the thinnest cross-section portion of each of the plurality of blades.

2. The rotating screen of claim 1, wherein at least the leading edge of each of the blades is sharp.

3. The rotating screen of claim 1, wherein the airfoil shape of the blades is configured to induce an airflow in a direction substantially parallel to the rotational axis in response to rotation of the screen about the rotational axis.

4. The rotating screen of claim 3, wherein the blades each include a suction surface and a pressure surface opposite the suction surface, the suction surface and the pressure surface together defining the airfoil shape of the blades.

5. The rotating screen of claim 4, wherein at least one of the suction surface and the pressure surface has an arcuate shape.

6. The rotating screen of claim 4, wherein the blades each define a blade span extending between the root and the tip, and wherein the blades each define a rake that varies along the blade span.

7. The rotating screen of claim 6, wherein the blades each define a pitch angle that is between about 25 degrees and about 45 degrees along the entire blade span.

8. The rotating screen of claim 1, wherein at least one of the plurality of blades includes a boss integrally formed with the blade.

9. The rotating screen of claim 8, wherein the boss is formed on the trailing edge of the blade.

10. The rotating screen of claim 1, wherein the plurality of blades includes between 4 blades and 16 blades.

11. An engine comprising:

a crankcase;

a cover at least partially enclosing the crankcase;

a centrifugal fan that is rotatable while the engine is in use for discharging a cooling airflow between the crankcase and the cover;

a screen coupled for co-rotation with the centrifugal fan, the screen including a hub including a rotational axis, a plurality of blades extending radially outwardly from the hub, each of the blades including a root adjacent the hub, a tip, a sharpened leading edge extending between the root and the tip, and a trailing edge extending between the root and the tip, the blades also including an airfoil shape, and a band concentric with the hub and interconnecting the tips of the respective blades.

12. The engine of claim 11, wherein the airfoil shape of the blades is configured to induce an airflow toward the centrifugal fan in response to rotation of the screen about the rotational axis.

13. The engine of claim 12, wherein the blades each include a suction surface and a pressure surface opposite the suction surface, the suction surface and the pressure surface together defining the airfoil shape of the blades.

14. The engine of claim 13, wherein at least one of the suction surface and the pressure surface has an arcuate shape.

15. The engine of claim 13, wherein the blades each define a blade span extending between the root and the tip, and wherein the blades each define a rake that varies along the blade span.

16. The engine of claim 15, wherein the blades each define a pitch angle that is between about 25 degrees and about 45 degrees along at least a portion of the blade span.

17. The engine of claim 11, wherein at least one of the blades includes a boss integrally formed as a single piece with the blade.

18. The engine of claim 17, wherein the boss is formed on the trailing edge of the blade.

19. The engine of claim 17, wherein the boss on the screen is a first boss, wherein the centrifugal fan includes a plurality of fan blades configured to discharge the cooling airflow in a radially outward direction, and wherein the centrifugal fan further includes a second boss.

20. The engine of claim 19, wherein the second boss is engaged with the first boss to orient the screen relative to the centrifugal fan.

21. The engine of claim 11, wherein the plurality of blades includes between 4 blades and 16 blades.

22. The engine of claim 11, further comprising a stationary screen coupled to the cover and at least partially overlying the screen coupled for co-rotation with the centrifugal fan.

23. The engine of claim 11, wherein the cover includes an annular channel, and wherein the band is at least partially positioned within the channel.

24. The engine of claim 23, wherein the cover includes an inlet aperture in which the screen is at least partially positioned, and wherein the annular channel surrounds the inlet aperture.

25. The engine of claim 24, wherein the cover includes a flange surrounding the annular channel, and wherein the engine further includes a stationary screen fastened to the flange.

* * * * *